US010104993B2

(12) United States Patent
El-Saden et al.

(10) Patent No.: US 10,104,993 B2
(45) Date of Patent: Oct. 23, 2018

(54) SEAL MECHANISM FOR BEVERAGE CONTAINER

(71) Applicant: Ignite USA, LLC, Chicago, IL (US)

(72) Inventors: Sami M. El-Saden, Winnetka, IL (US); Daniel M. Wodka, Chicago, IL (US); Joe Y. Chiou, Wilmette, IL (US)

(73) Assignee: IGNITE USA, LLC, Chicago, IL (US)

( * ) Notice: Subject to any disclaimer, the term of this patent is extended or adjusted under 35 U.S.C. 154(b) by 0 days.

(21) Appl. No.: 14/512,869

(22) Filed: Oct. 13, 2014

(65) Prior Publication Data

US 2015/0028044 A1 Jan. 29, 2015

Related U.S. Application Data

(63) Continuation of application No. 14/094,128, filed on Dec. 2, 2013, now Pat. No. 8,863,979, which is a (Continued)

(51) Int. Cl.
*A47G 19/22* (2006.01)
*B65D 55/02* (2006.01)
(Continued)

(52) U.S. Cl.
CPC ..... *A47G 19/2272* (2013.01); *B65D 43/22* (2013.01); *B65D 43/26* (2013.01);
(Continued)

(58) Field of Classification Search
CPC .... B65D 47/249; B65D 47/26; B65D 27/268; B65D 51/1683; B65D 83/22; B65D 55/02; B65D 55/12
(Continued)

(56) References Cited

U.S. PATENT DOCUMENTS 830,142 A 9/1906 Ebbing
1,072,588 A 9/1913 Duncan
(Continued)

FOREIGN PATENT DOCUMENTS

CN 2803165 Y 8/2006
CN 201131575 Y 10/2008
(Continued)

OTHER PUBLICATIONS

Supplementary European Search Report for Application No. EP 12 83 1487, dated Jun. 16, 2015.
(Continued)

*Primary Examiner* — Jeffrey Allen
*Assistant Examiner* — Jennifer Castriotta
(74) *Attorney, Agent, or Firm* — Marshall, Gerstein & Borun LLP

(57) ABSTRACT

A lid assembly for a beverage container having a lid housing, a seal assembly and a trigger member. The seal assembly has one or more drink seals that engage a corresponding one or more drink apertures to close the drink apertures. The seal assembly is rotatedly connected to the lid housing and movable between a use position and a cleaning position for cleaning. The trigger member is connected to the lid housing and is capable of engaging the seal assembly in the use position, but not in the cleaning position. The trigger member is connected to the seal assembly such that the vent aperture is opened during a first portion of the operation of the trigger, and the drink apertures are opened during a second portion of the operation of the trigger so that the vent aperture is opened before the drink apertures.

20 Claims, 8 Drawing Sheets

Related U.S. Application Data continuation of application No. 13/610,406, filed on Sep. 11, 2012, now Pat. No. 8,727,176.

(60) Provisional application No. 61/534,192, filed on Sep. 13, 2011.

(51) Int. Cl.

| | |
|---|---|
| ***B65D 51/16*** | (2006.01) |
| ***B65D 51/18*** | (2006.01) |
| ***B65D 43/22*** | (2006.01) |
| ***B65D 43/26*** | (2006.01) |

(52) U.S. Cl.
CPC ..... *B65D 51/1644* (2013.01); *B65D 51/18* (2013.01); *B65D 55/02* (2013.01)

(58) Field of Classification Search
USPC ..... 220/715, 254.5, 254.9, 810, 811, 825, 220/831; 222/518, 517, 508, 469, 559, 222/560, 153.14, 153.13
See application file for complete search history.

(56) References Cited

U.S. PATENT DOCUMENTS 2,193,232 A 3/1940 Hacmac
2,447,870 A 8/1948 Polcyn
2,622,420 A 12/1952 Rice
2,799,437 A 7/1957 Jepson
3,059,816 A 10/1962 Goldstein
3,171,574 A * 3/1965 Simms ..... B65D 23/106 222/467
D209,483 S 12/1967 Frank
3,558,023 A * 1/1971 Yoshito ..... A47J 41/0027 220/756
3,635,380 A 1/1972 Fitzgerald
3,739,938 A 6/1973 Paz
3,964,631 A 6/1976 Albert
3,967,748 A 7/1976 Albert
3,972,443 A 8/1976 Albert
4,094,433 A 6/1978 Numbers
4,099,642 A 7/1978 Nergard
4,133,446 A 1/1979 Albert
4,136,799 A 1/1979 Albert
4,171,060 A 10/1979 Howard et al.
4,212,408 A 7/1980 Valenzona
4,276,992 A 7/1981 Susich
4,303,173 A 12/1981 Negard
D288,667 S 3/1987 Miner
D291,537 S 8/1987 Crawford et al.
4,686,725 A 8/1987 Mitchell
4,706,313 A 11/1987 Murphy
4,711,372 A 12/1987 Gach
4,712,704 A 12/1987 Ramsey et al.
4,779,766 A 10/1988 Kinsley
4,782,985 A * 11/1988 Kinsley ..... B65D 47/0814 222/481.5
4,801,053 A 1/1989 Kaster
4,881,668 A 11/1989 Kitterman et al.
4,901,387 A 2/1990 Luke
4,911,337 A * 3/1990 Rosenthal ..... B65D 47/0809 220/819
D315,872 S 4/1991 Bixler
5,025,519 A 6/1991 Spann et al.
5,039,158 A 8/1991 Maier
5,070,560 A 12/1991 Wilkinson
5,082,134 A 1/1992 Ramsey
5,118,014 A 6/1992 Hestehave et al.
5,153,977 A 10/1992 Toida et al.
5,163,196 A 11/1992 Graebe et al.
5,169,016 A 12/1992 Hinz, Jr.
5,179,742 A 1/1993 Oberle
5,186,353 A 2/1993 Ramsey
5,199,597 A 4/1993 Gladish
5,222,623 A 6/1993 Eger et al.
5,244,113 A 9/1993 Stymiest
5,249,703 A 10/1993 Karp
5,252,278 A 10/1993 Spann et al.
5,307,950 A 5/1994 Li
D355,322 S 2/1995 Ackley et al.
5,412,821 A 5/1995 Wilkinson
5,427,271 A 6/1995 Wang
5,461,741 A 10/1995 Graebe
5,462,185 A 10/1995 Walker, III
5,465,866 A 11/1995 Belcastro
5,477,980 A 12/1995 Chaffin
5,485,938 A 1/1996 Boersma
D367,611 S 3/1996 Wagner et al.
D373,927 S 9/1996 Kramer et al.
5,570,797 A 11/1996 Yeh
5,573,139 A 11/1996 Yeh
5,580,504 A 12/1996 Spann et al.
5,586,346 A 12/1996 Stacy et al.
5,596,781 A 1/1997 Graebe
5,606,754 A 3/1997 Hand et al.
5,630,238 A 5/1997 Weismiller et al.
5,649,331 A 7/1997 Wilkinson et al.
5,652,985 A 8/1997 Wilkinson et al.
5,666,681 A 9/1997 Meyer et al.
5,680,951 A 10/1997 Feltman, III et al.
5,689,845 A 11/1997 Sobieralski
D386,948 S 12/1997 Wissinger
5,753,289 A 5/1998 Ness
D394,778 S 6/1998 Arns et al.
D397,905 S 9/1998 Hsu
5,845,352 A 12/1998 Matsler et al.
D404,613 S 1/1999 Hatsumoto et al.
D405,011 S 2/1999 DeCoster et al.
D406,006 S 2/1999 Hatsumoto et al.
D408,221 S 4/1999 Asberg
D416,755 S 11/1999 Trombly
5,987,668 A 11/1999 Ackley
D417,360 S 12/1999 Bickert et al.
6,003,711 A * 12/1999 Bilewitz ..... B65D 43/0218 220/253
6,010,029 A 1/2000 Wang
6,036,271 A 3/2000 Wilkinson et al.
6,053,474 A 4/2000 Stucke et al.
6,098,834 A 8/2000 Hatsumoto et al.
6,102,244 A 8/2000 Kuwano et al.
6,119,291 A 9/2000 Osborne et al.
6,126,035 A 10/2000 Schaper et al.
6,158,608 A 12/2000 Schlattl
RE37,016 E 1/2001 Morano
D437,229 S 2/2001 Andrew
6,223,369 B1 5/2001 Maier et al.
6,276,560 B1 8/2001 Belcastro
D447,693 S 9/2001 Warner et al.
6,324,709 B1 12/2001 Ikeda et al.
6,351,863 B1 3/2002 Meyer et al.
6,352,166 B1 3/2002 Copeland
6,401,990 B1 6/2002 Walters et al.
D460,894 S 7/2002 Ziegenfus et al.
6,443,325 B1 9/2002 Schaper et al.
6,471,085 B1 10/2002 Gallo
D470,009 S 2/2003 Turchi et al.
D471,808 S 3/2003 de Castro Couto
6,557,717 B1 5/2003 Keck
6,623,080 B2 9/2003 Clapper
6,644,490 B2 11/2003 Clarke
6,679,397 B2 1/2004 Smith et al.
6,701,556 B2 3/2004 Romano et al.
6,702,137 B1 3/2004 Kowa et al.
6,732,875 B2 5/2004 Smith et al.
6,732,876 B2 5/2004 Belcastro
6,732,964 B2 5/2004 Couchey
6,763,964 B1 7/2004 Hurlbut et al.
6,782,574 B2 8/2004 Totton et al.
D500,428 S 1/2005 Ward et al.
6,854,615 B2 2/2005 von Ronn et al.
D502,844 S 3/2005 Roho
6,874,185 B1 4/2005 Phillips et al.
6,901,617 B2 6/2005 Sprouse, II et al.

(56) References Cited

U.S. PATENT DOCUMENTS

| | | | |
|---|---|---|---|
| D508,185 | S | 8/2005 | Gauss |
| 6,922,863 | B2 | 8/2005 | Giori et al. |
| 6,928,681 | B1 | 8/2005 | Stacy |
| 6,952,852 | B2 | 10/2005 | Reeder et al. |
| 6,976,281 | B2 | 12/2005 | Schunk et al. |
| 6,978,910 | B2 | 12/2005 | Sanders et al. |
| D513,452 | S | 1/2006 | Parve |
| 7,011,227 | B2 | 3/2006 | Ward et al. |
| D522,794 | S | 6/2006 | Imar |
| D523,340 | S | 6/2006 | Westphal |
| 7,073,678 | B1 | 7/2006 | Dibdin et al. |
| D526,898 | S | 8/2006 | Isono et al. |
| D526,899 | S | 8/2006 | Mangin et al. |
| 7,086,107 | B2 | 8/2006 | Ellis et al. |
| D529,379 | S | 10/2006 | Mengeu et al. |
| D529,761 | S | 10/2006 | Trombly |
| D533,064 | S | 12/2006 | Glynn et al. |
| 7,195,137 | B2 | 3/2007 | Belcastro |
| D540,625 | S | 4/2007 | Sandberg |
| 7,201,288 | B2 | 4/2007 | von Ronn et al. |
| D541,572 | S | 5/2007 | Watanabe |
| D544,300 | S | 6/2007 | Tien |
| 7,229,134 | B2 | 6/2007 | Ito |
| D547,122 | S | 7/2007 | Gluck |
| D547,611 | S | 7/2007 | Seum et al. |
| D548,008 | S | 8/2007 | Lin |
| D548,508 | S | 8/2007 | Tonelli |
| D552,990 | S | 10/2007 | Vogel |
| D554,433 | S | 11/2007 | Gluck |
| D554,992 | S | 11/2007 | Mangin et al. |
| D555,000 | S | 11/2007 | Bunce et al. |
| D555,514 | S | 11/2007 | Munn |
| D555,970 | S | 11/2007 | Schreitmueller et al. |
| D558,111 | S | 12/2007 | Banks, III |
| D560,435 | S | 1/2008 | Meehan |
| D564,840 | S | 3/2008 | Williams |
| D564,841 | S | 3/2008 | Clemens et al. |
| D564,874 | S | 3/2008 | Mangin et al. |
| D569,182 | S | 5/2008 | Homma |
| D572,531 | S | 7/2008 | Romandy et al. |
| D573,404 | S | 7/2008 | Wahl |
| 7,413,096 | B2 | 8/2008 | Morgan et al. |
| D577,582 | S | 9/2008 | Walsh et al. |
| D577,958 | S | 10/2008 | Homma |
| D581,727 | S | 12/2008 | Pinelli et al. |
| D584,107 | S | 1/2009 | George |
| D587,060 | S | 2/2009 | Tong Chi Chung |
| D587,969 | S | 3/2009 | Gilbert |
| D588,411 | S | 3/2009 | Watanabe |
| D589,750 | S | 4/2009 | Liu et al. |
| 7,513,380 | B2 | 4/2009 | Canedo |
| D592,012 | S | 5/2009 | Carreno |
| D592,456 | S | 5/2009 | Pinelli |
| D592,905 | S | 5/2009 | Pinelli |
| D592,913 | S | 5/2009 | Pinelli |
| 7,546,933 | B2 | 6/2009 | Pinelli |
| D611,764 | S | 3/2010 | Wahl et al. |
| D623,473 | S | 9/2010 | Chen |
| D623,474 | S | 9/2010 | Carlson et al. |
| D623,476 | S | 9/2010 | Carlson et al. |
| D629,653 | S | 12/2010 | Gullickson et al. |
| D634,161 | S | 3/2011 | Roth et al. |
| RE42,484 | E | 6/2011 | Kitamura et al. |
| D640,094 | S | 6/2011 | Carlson et al. |
| 7,997,442 | B2 | 8/2011 | Pinelli |
| D648,985 | S | 11/2011 | Chiu et al. |
| D656,787 | S | 4/2012 | Phillips et al. |
| D658,443 | S | 5/2012 | Chiu et al. |
| D675,873 | S | 2/2013 | Miller et al. |
| D676,278 | S | 2/2013 | Wong |
| 8,459,510 | B2 | 6/2013 | Richards et al. |
| 8,464,895 | B2 | 6/2013 | Gilbert et al. |
| D686,074 | S | 7/2013 | Brinckerhoff et al. |
| 8,863,979 | B2 | 10/2014 | El-Saden et al. |
| 2003/0071041 | A1 | 4/2003 | Vogel |
| 2004/0108336 | A1* | 6/2004 | Tardif ..... A47J 41/0027 222/153.14 |
| 2005/0028289 | A1 | 2/2005 | Hakamium |
| 2005/0029265 | A1 | 2/2005 | Morgan et al. |
| 2006/0043091 | A1 | 3/2006 | Pinelli et al. |
| 2006/0226160 | A1 | 10/2006 | Elsaden et al. |
| 2007/0170184 | A1 | 7/2007 | Canedo |
| 2007/0210093 | A1 | 9/2007 | Pinelli |
| 2010/0213221 | A1 | 8/2010 | Vogel et al. |
| 2012/0018459 | A1* | 1/2012 | Richards ..... B65D 47/249 222/484 |
| 2012/0285961 | A1 | 11/2012 | Roth et al. |
| 2013/0062358 | A1 | 3/2013 | El-Saden et al. |
| 2013/0119060 | A1 | 5/2013 | Chiou et al. |
| 2013/0134164 | A1* | 5/2013 | Gilbert ..... A47G 19/2272 220/254.9 |
| 2014/0084002 | A1 | 3/2014 | El-Saden et al. |
| 2014/0197170 | A1* | 7/2014 | Carlile ..... B65D 47/249 220/262 |

FOREIGN PATENT DOCUMENTS

| | | |
|---|---|---|
| JP | 2005193944 | 7/2005 |
| JP | 2005-278855 A | 10/2005 |
| NL | 1 026 259 C2 | 11/2005 |
| WO | 2005/115204 | 12/2005 |
| WO | WO-2005/115204 A1 | 12/2005 |

OTHER PUBLICATIONS

*CamelBak Products, LLC* v. *Ignite USA, LLC,* Decision Instituting Inter Partes Review of U.S. Pat. No. 8,863,799 (IPR2015-01034), entered Aug. 26, 2015.

International Preliminary Report on Patentability for International Application No. PCT/US2012/064801, dated May 20, 2014.

Corrected Brief of Patent Appellant *Ignite USA, LLC, Ignite USA LLC* v. *Camelbak Products, LLC,* Case No. 16/2747, Document: 18, In the United States Court of Appeals for the Federal Circuit, filed Jan. 10, 2017.

Brief of Appellee *Camelbak Products, LLC, Ignite USA, LLC* v. *Camelbak Products, LLC,* Case No. 16/2747, Document: 21, In the United States Court of Appeals for the Federal Circuit, filed Feb. 21, 2017.

Reply Brief of Patent Appellant *Ignite USA, LLC, Ignite USA, LLC* v. *Camelbak Products, LLC,* Case No. 16/2747, Document: 26, In the United States Court of Appeals for the Federal Circuit, filed Mar. 14, 2017.

Communication pursuant to Article 94(3) EPC, European patent application No. 12831487.9, dated May 31, 2016.

Complaint for Patent Infringement, *Ignite USA, LLC,* v. *Camelbak Products, LLC,* Civil Action No. 1:14-cv-09210, In the United States District Court for the Northern District of Illinois, Eastern Division, filed Nov. 17, 2014.

Defendant Camelbak Products, LLC's Answer, Affirmative Defenses and Counterclaims, *Ignite USA, LLC,* v. *Camelbak Products, LLC,* Civil Action No. 1:14-cv-09210, In the United States District Court for the Northern District of Illinois, Eastern Division, filed Jan. 9, 2015.

Final Written Decision, Inter Partes Review, 35 U.S.C. § 318(a) and 37 CFR § 42.73, Case IPR2015-01034, entered on Jun. 7, 2016.

Order Granting Defendant Camelbak Products, LLC's Motion to Stay, *Ignite USA, LLC,* v. *Camelbak Products, LLC,* Civil Action No. 1:14-cv-09210, In the United States District Court for the Northern District of Illinois, Eastern Division, issued Aug. 27, 2015.

Patent Owner Ignite USA, LLC's Notice of Appeal, Case IPR2015-01034, filed with the USPTO on Sep. 30, 2016.

Petition for Inter Partes Review of U.S. Pat. No. 8,863,979, as filed with the USPTO on Apr. 10, 2015.

Plaintiff/Counter-Defendant Ignite USA, LLC's Answer and Affirmative Defenses to Defendant/Counterclaimant Camelbak Products, LLC's Counterclaims, *Ignite USA, LLC,* v. *Camelbak Products, LLC,* Civil Action No. 1:14-cv-09210, In the United States District Court for the Northern District of Illinois, Eastern Division, filed Feb. 2, 2015.

(56) References Cited

OTHER PUBLICATIONS

The First Office Action (with English translation), Chinese patent application No. 201280055706.7, dated Jan. 27, 2015.
The Second Office Action (with English translation), Chinese patent application No. 201280055706.7, dated Aug. 31, 2015.
Appeal Decision for *Ignite USA, LLC* v. *Camelbak Products, LLC,* Case No. 16/2747, In the United States Court of Appeals for the Federal Circuit, decided Oct. 12, 2017.
Joint Notice of Stipulation of Dismissal for *Ignite USA, LLC* v. *Camelbak Products, LLC,* Civil Action No. 1:14-cv-09210, In the United States Court for the Northern District of Illinois Eastern Division, dated Dec. 15, 2017.

* cited by examiner

FIG. 10
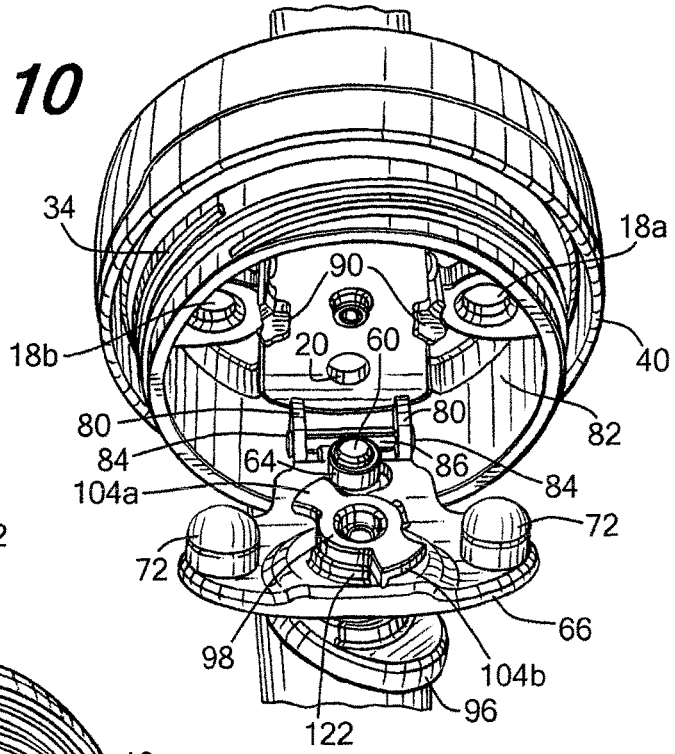
FIG. 11
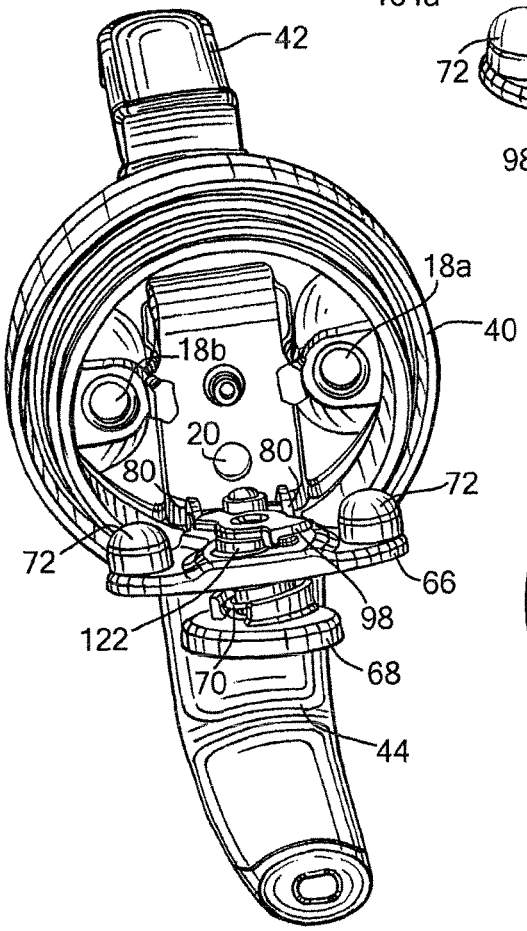
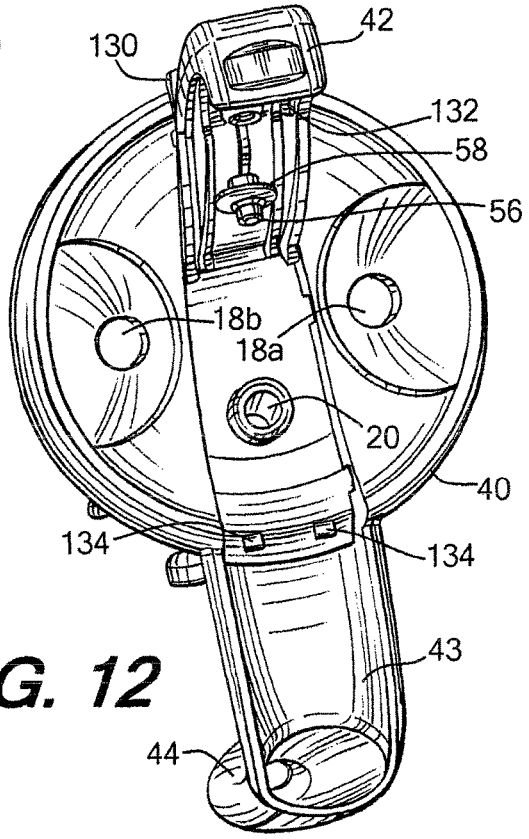
FIG. 12

SEAL MECHANISM FOR BEVERAGE CONTAINER

CROSS-REFERENCE TO RELATED APPLICATIONS

This application is a continuation of U.S. patent application Ser. No. 14/094,128, filed on Dec. 2, 2013, which is a continuation of U.S. patent application Ser. No. 13/610,406, filed Sep. 11, 2012 (now U.S. Pat. No. 8,727,176, issued May 20, 2014), which claims the benefit of U.S. Provisional Patent Application No. 61/534,192, filed Sep. 13, 2011, all of which are expressly incorporated herein by reference and made a part hereof.

FEDERALLY SPONSORED RESEARCH OR DEVELOPMENT

Not Applicable.

TECHNICAL FIELD

The present invention relates generally to a beverage container, and more specifically to a movable trigger/seal mechanism for a beverage container.

BACKGROUND OF THE INVENTION

Beverage containers and seal/trigger mechanisms for beverage containers are well known in the art. Traditionally, seal/trigger mechanisms are located in the lid of the beverage container and are secured in a fixed location in the lid. While such beverage containers and seal/trigger mechanisms according to the prior art provide a number of advantages, they nevertheless have certain limitations. For example, debris may be retained between certain components that are secured together. Further, the area between the seals associated with the seal mechanism and the lid, and other components of the seal mechanism are difficult to properly clean, especially in a dishwasher environment. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a lid for a beverage container having a drop-down seal assembly for easy cleaning of the seal assembly and the associated drink apertures, but where the seal assembly is not disassembled or removed from the lid during conversion from the use position to the cleaning position.

The disclosed subject technology further relates to a lid having a seal assembly and a trigger member. The seal assembly has a first drink seal that engages a first drink aperture to close the first drink aperture. The seal assembly is rotatedly connected to the lid housing and movable between a first or operable position, and a second or cleaning position. The seal assembly can be rotated away from a drink surface of the lid housing so that the first drink aperture is open for cleaning the lid assembly in the cleaning position. The trigger member is connected to the lid housing and is capable of engaging the seal assembly in the operable position, but the trigger assembly cannot engage the seal assembly in the cleaning position.

The disclosed technology further relates to an embodiment where the seal assembly further comprises a second drink seal that engages a second drink aperture to close the second drink aperture.

The disclosed technology further relates to an embodiment where the trigger member is rotatedly connected to the lid housing, and wherein the trigger member can be rotated from a normal or use position to an open position for cleaning purposes.

The disclosed technology further relates to an embodiment having a locking member to lock the seal assembly in the operable position when the locking member is in a locked state. The locking member is transitionable to an unlocked state to allow the seal assembly to translate to the cleaning position.

The disclosed technology further relates to an embodiment comprising a trigger lock connected to the trigger member. The trigger lock prevents engagement of the seal assembly by the trigger member when the seal assembly is in the operable position.

The disclosed technology further relates to a lid assembly for a drinking container comprising a lid housing, a seal assembly and a trigger. The lid housing has a first drink aperture, a second drink aperture, and a separate vent aperture. The seal assembly has a first drink seal for the first drink aperture, a second drink seal for the second drink aperture, and a vent seal for the vent aperture. The trigger is mechanically connected to the seal assembly during operation of the trigger to move the first and second drink seals and the vent seal from a closed position to an open position, wherein the vent aperture is opened during a first portion of the operation of the trigger, and wherein the first and second drink apertures are opened during a second portion of the operation of the trigger so that the vent aperture is opened before the first and second drink apertures.

The disclosed technology further relates to a lid assembly for a drinking container comprising a lid housing, a seal assembly and a trigger. The lid assembly further comprises a vent spring operably connected to the vent seal of the seal assembly, and a drink spring operably connected to the first and second drink seals of the seal assembly, wherein a spring constant of the drink spring is greater than a spring constant of the vent spring.

The disclosed technology further relates to a lid assembly for a drinking container comprising a lid housing, a seal assembly, and a trigger mechanism. The lid housing has a first drink aperture, a second drink aperture, and a separate vent aperture. The seal assembly has a first drink seal and a second drink seal, and a vent seal is operably connected to the seal assembly. The trigger mechanism is mechanically connected to both the vent seal and to the seal assembly during operation of the trigger mechanism to move the first and second drink seals and the vent seal from a closed position to an open position.

The disclosed technology further relates to an embodiment where the lid housing has a centerline extending about a surface of the lid housing, and wherein a first drink opening is positioned on one side of the centerline and a second drink opening is positioned on the opposing side of the centerline.

The disclosed technology further relates to a lid assembly for a drinking container comprising a lid housing, a seal assembly and a trigger mechanism. The lid housing has a first drink aperture and a separate vent aperture. The seal assembly has a first drink seal and a vent seal. The trigger mechanism is mechanically connected to the seal assembly during operation of the trigger mechanism to move the first drink seal and the vent seal from a closed position to an open position. In this embodiment the trigger mechanism has three positions, a first position, a second position and a third position. The vent aperture is opened and the first drink aperture remains closed when the trigger mechanism reaches the first position. The first drink aperture is opened after the vent aperture when the trigger mechanism reaches the second position. And, the vent opening is subsequently closed but the first drink aperture remains open when the trigger mechanism is in the third position.

The disclosed technology further relates to a lid assembly for a beverage container comprising a lid housing having a drink aperture and a vent aperture. The lid further has a seal assembly having a drink seal that engages the drink aperture to close the drink aperture. A trigger assembly is connected to the lid housing to operate the seal assembly, and a trigger lock is connected to the trigger assembly. The trigger lock is moveable between a first or unlocked position and a second or locked position. The trigger lock forms a continuous ring with an upper portion of the lid housing when the trigger lock is in the unlocked position, and wherein the continuous ring is broken when the trigger lock is transitioned to the locked position.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present invention, it will now be described by way of example only, not by way of limitation, with reference to the accompanying drawings in which:

FIG. 10 is a partial bottom perspective view of one embodiment of the seal mechanism in the open position.

FIG. 11 is a partial bottom perspective view of one embodiment of the seal mechanism in the open position.

FIG. 12 is a top perspective view of one embodiment of the lid housing with the trigger button in the open position.

DETAILED DESCRIPTION

Figure 1:
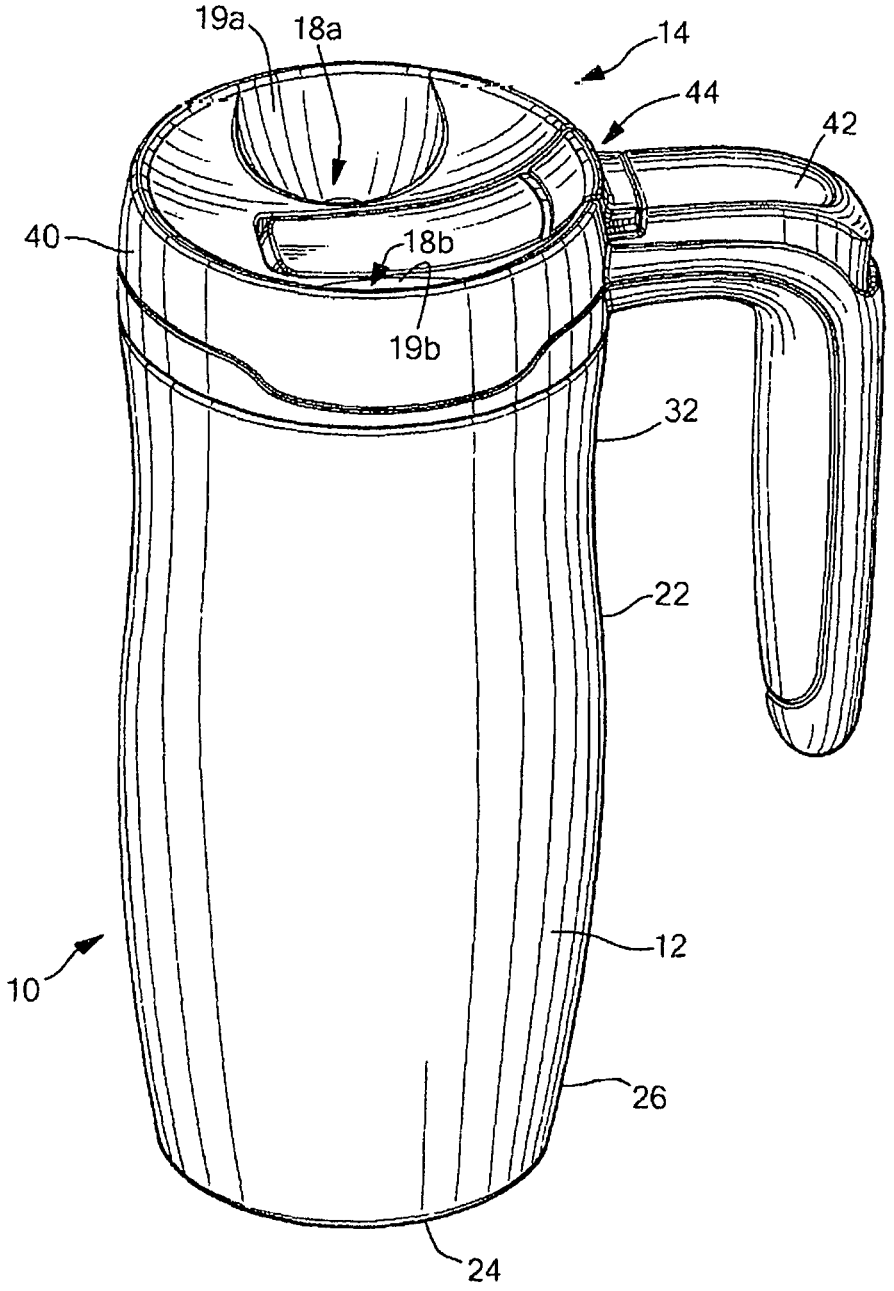
FIG. 1 is a perspective view of one example of a beverage container with a moveable and lockable seal mechanism and trigger mechanism.
Figure 2:
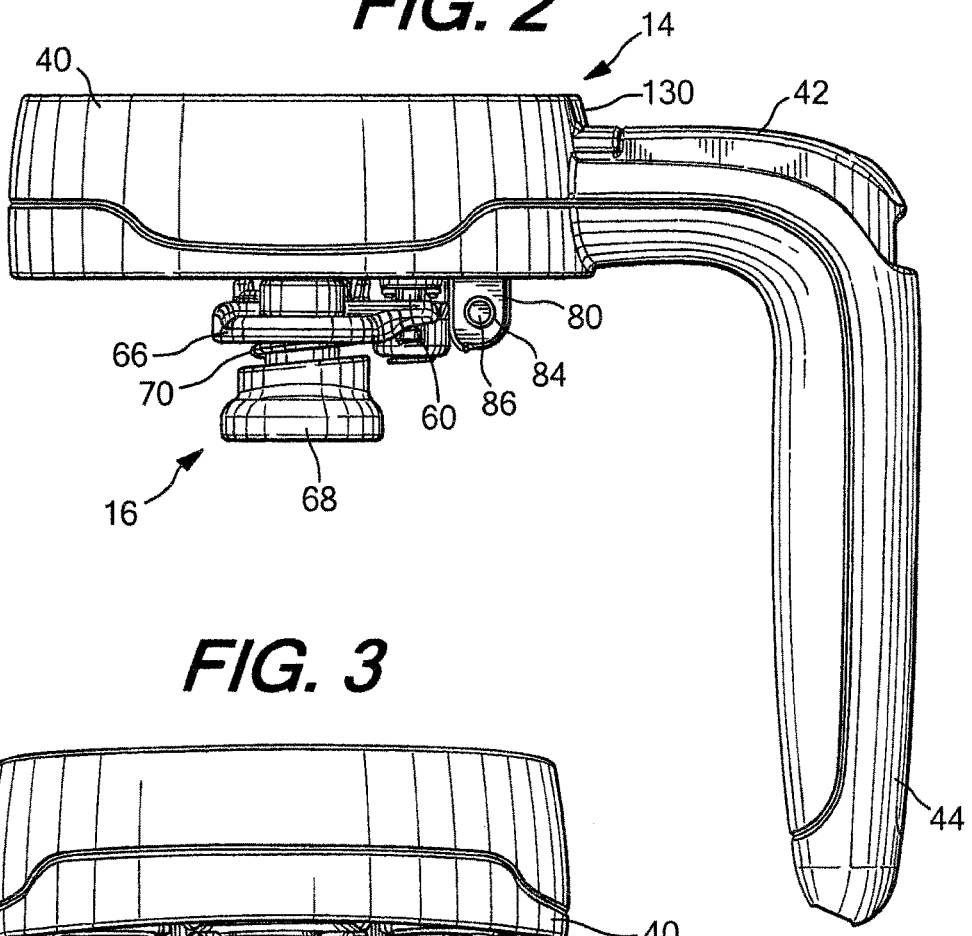
FIG. 2 is a side elevation view of one embodiment of a movable seal mechanism pivotably connected to a lid for a beverage container, the seal mechanism being in the locked or closed position.
Figure 3:
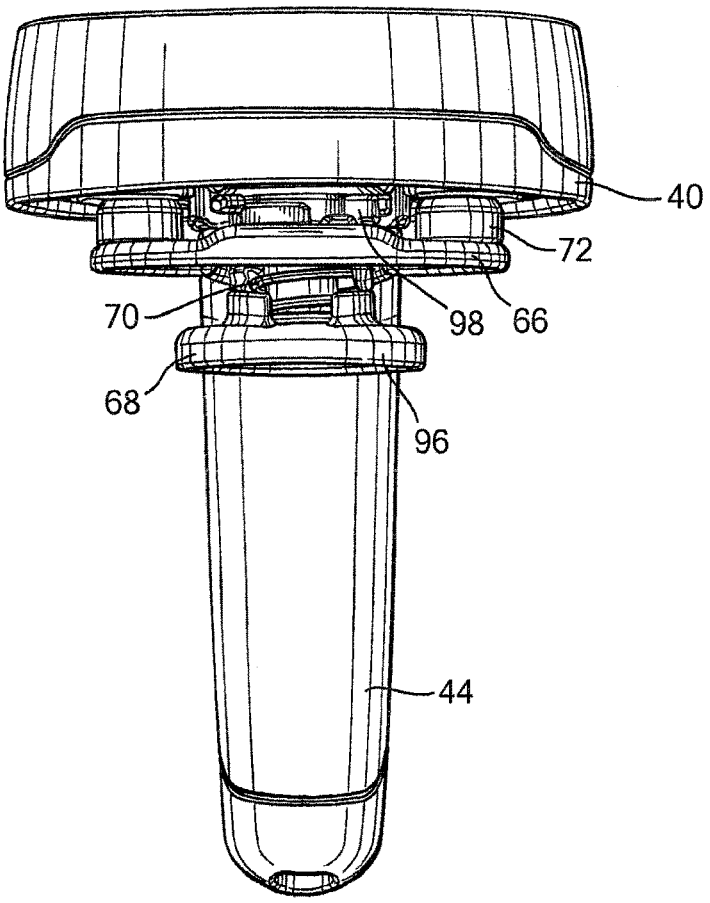
FIG. 3 is a front elevation view of FIG. 2.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the figures, and specifically to FIGS. 1-5, there is shown a beverage container 10 generally comprising a container body 12 and a lid assembly 14. The lid assembly 14 has a seal mechanism 16 or seal assembly 16 that operates to open and close at least one drinking aperture 18*a* or 18*b* in the lid assembly 14, and preferably to open and close two drinking apertures 18*a*, 18*b* in the lid assembly. Additionally, the seal assembly 16 also preferably operates to open and close a vent aperture 20 (see FIGS. 10-14) to allow pressure residing within the container body 12 to be initially released through the vent aperture 20 as opposed to the drink apertures 18*a*, 18*b*. In a preferred embodiment, as shown in FIGS. 5 and 10-12, a portion of the seal assembly 16 can be released from a fixed or closed position (i.e., the use position) to a released or open position (i.e., the cleaning position) to allow for cleaning of various components of the seal assembly 16 and for cleaning of areas between components of the seal assembly 16 and the lid assembly 14. Additionally, as shown in FIGS. 5 and 10-12, the trigger button 42 can be moved from the fixed, use or closed position to a released or open position to allow for cleaning of the area between the trigger button 42 and the lid housing 40. Importantly, when the seal assembly 16 and the trigger button 42, respectively, are moved from the use position to the cleaning position, and while they remain in the cleaning position, they are still connected to the lid assembly 14. Accordingly, for cleaning purposes no components need to be removed from the lid assembly 14—they are at all times still connected to the lid assembly 14. Instead, they are relocated to a position that allows for cleaning of the important portions of the lid assembly but they are not removed and therefore cannot be misplaced or disassociated from the lid assembly 14.

In one embodiment the container body 12 comprises a side wall member 22, a bottom member 24 toward a distal end 26 of the side wall member 22, and a liquid retaining cavity (not shown) therebetween. Further, in one embodiment the container body 12 generally comprises a two-part construction of an inner member and an outer member to provide an insulating feature. The area between the inner member and the outer member may be filled with an insulating material or it may be under vacuum.

Figure 6:
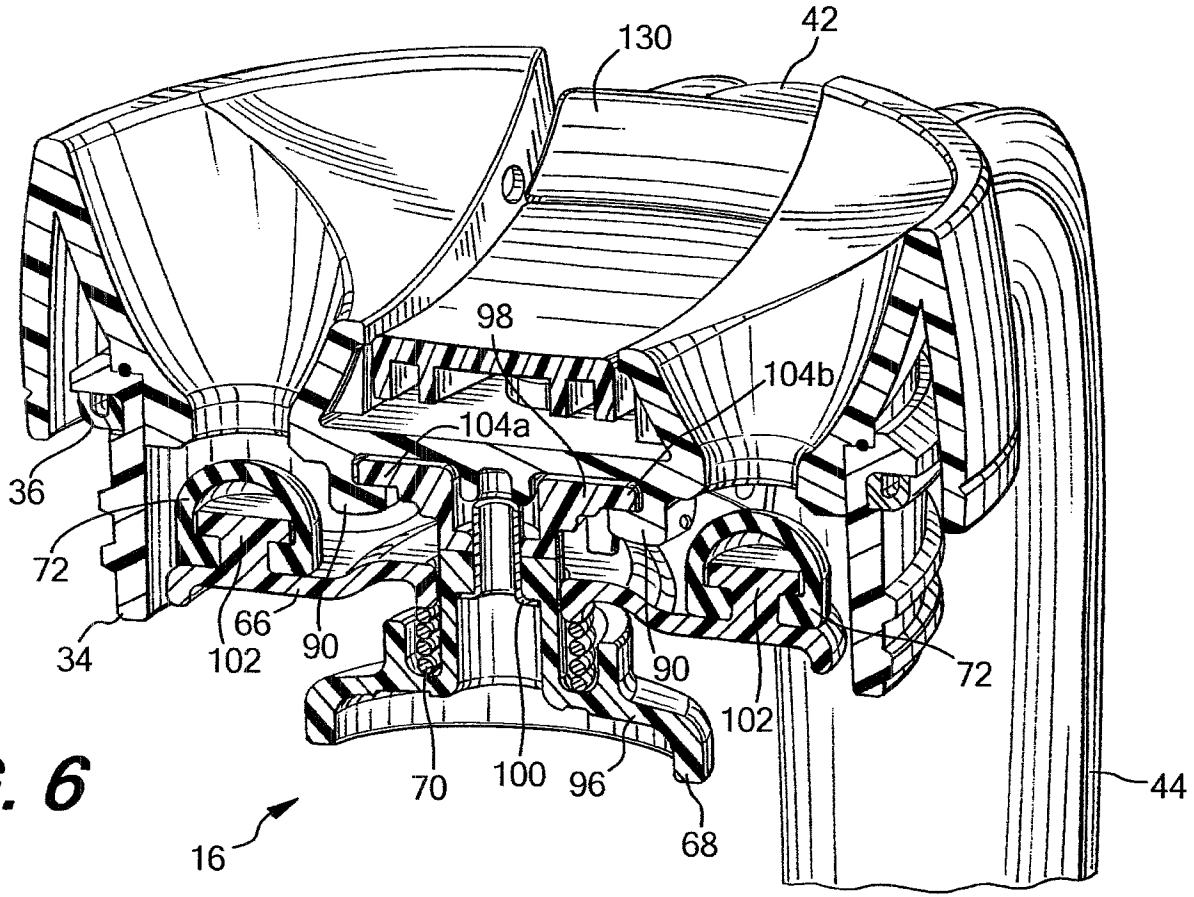
FIG. 6 is a partial cross-section perspective view of one embodiment of the seal mechanism with the cross section being through the drink seals.
Figure 7:
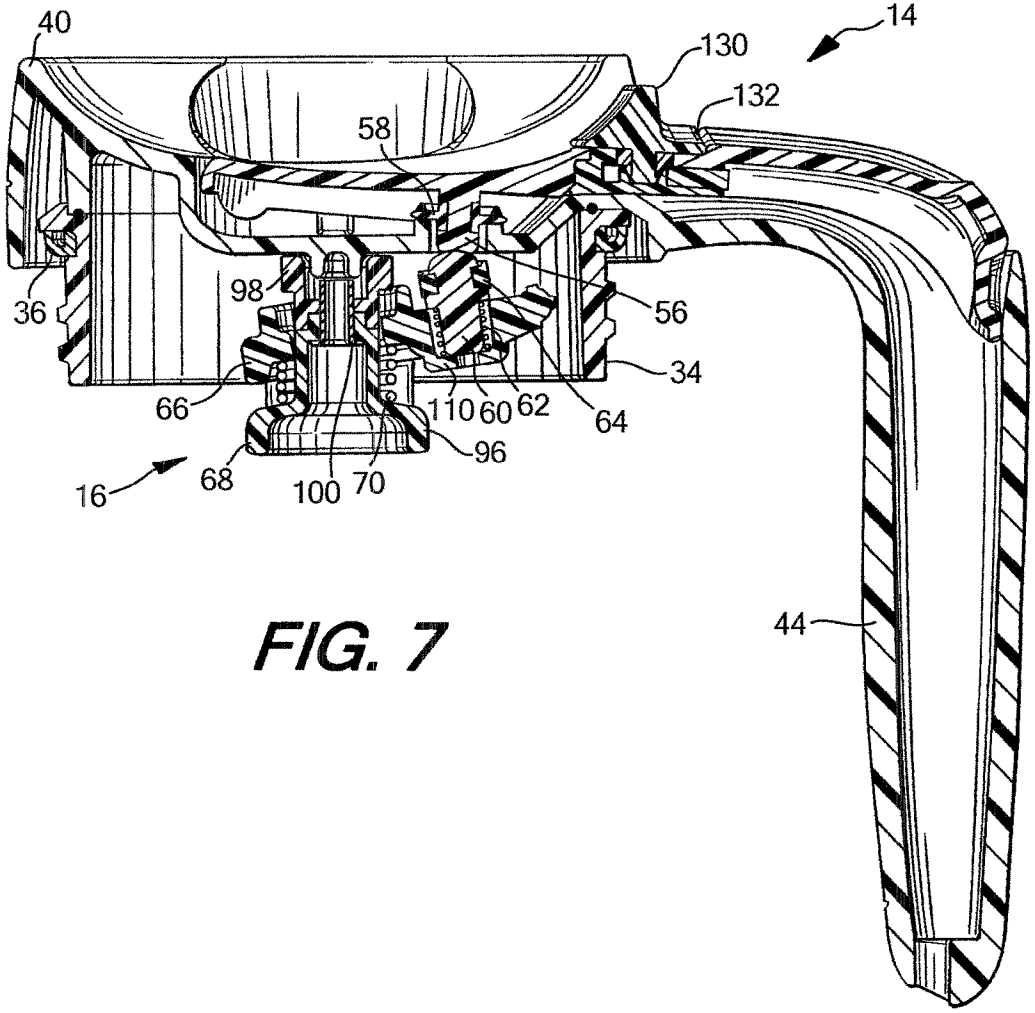
FIG. 7 is a partial cross-section side view of one embodiment of the seal mechanism with the cross section being through the vent seal.

The lid assembly 14 provides a closure to the cavity of the container body 12. In one embodiment, the container body 12 base has a receiver (not shown) at a proximal end 32 of the container body 12 for assisting in securing the lid assembly 14 to the container body 12, and in a preferred embodiment the lid assembly 14 is secured to the container body 12 via the thread ring 34 on the lid assembly 14 and a mating receiver on the container body 12, however, alternate connection means may be utilized. As shown in FIGS. 6 and 7, the lid assembly 14 includes a seal 36 that seals the connection between the container body 12 and the lid assembly 14 to assist in preventing liquid from escaping from the cavity of the container body 12.

In one embodiment the lid assembly 14 includes a lid housing 40 for retaining the seal assembly 16. In one embodiment the thread ring 34 extends from or is fixedly connected to the lid housing 40 as shown in FIG. 6. As shown in FIGS. 1, 5 and 7-9, the lid assembly 14 also has a trigger member or trigger button 42 that operates to actuate the seal assembly 16, and a trigger lock mechanism for locking the trigger member 42 and preventing the user from actuating the seal assembly 16. The lid housing 40 of the lid assembly 14 has a plurality of apertures therein. Preferably, the lid housing 40 contains the drink apertures 18*a*, 18*b* and the vent aperture 20 for providing access to the container cavity (not shown) through the lid housing 40. While the vent aperture 20 is provided in a top of the lid housing 40, it is understood that it may be located elsewhere in the lid housing 40, such as the side of the lid housing 40. In a preferred embodiment, the drink apertures 18*a*, 18*b* are located at the bottom of reservoirs 19*a*, 19*b* formed downwardly from the upper surface of the lid housing 40. With such structure, the drink apertures 18*a*, 18*b* are positioned a distance below the upper surface of the lid housing 40. The reservoirs 19*a* and 19*b* provide several functions. For example, the reservoirs 19*a* and 19*b* operate as a well and serve to allow the user to pool liquid that is being dispensed from the container 10 into the reservoirs 19*a* and 19*b*, including in a pre-fill step, prior to drinking by the user. This is especially beneficial when the liquid in the container 10 is hot and the user desires to allow the contents to briefly cool before being consumed. Additionally, the user is able to slurp the liquid in the reservoir 19*a* and 19*b* as opposed to drinking directly from the drink aperture. Notwithstanding this function, the surface angles and contour of the reservoirs 19*a* and 19*b* are designed to allow liquid that remains in the reservoir when the drink aperture is open to quickly traverse back through the drink aperture and into the container cavity so that less residual liquid remains outside of the drink seal to prevent unwanted drips of residual liquid.

In one embodiment the lid assembly 14 is a handled assembly having a plurality of drink apertures 18*a*, 18*b*. As such, a handle 44 extends from the lid housing 40 for allowing the user to grasp and hold drink container 10. In one embodiment, the trigger member or trigger button 42 resides partially within the handle 44 of the container 10, and preferably within a trigger cavity 43 on the exterior of the lid housing 40. Preferably, when a handle 44 is provided as part of the lid assembly 14, as shown in FIGS. 6 and 10-14, two drink apertures 18*a*, 18*b* are included so that the user can hold the handle 44 with either the user's right hand or left hand and still have a drink aperture positioned in a proper drinking location. Accordingly, in one embodiment one drink aperture 18*a* is positioned on one side of a centerline of the top of the lid housing 40, and the other drink aperture 18*b* is positioned on the opposing side of the centerline of the top of the lid housing 40 in a geometrically symmetric manner.

Similarly, as also shown in FIGS. 10-14, and as identified above, the lid housing 40 also contains a vent aperture 20 to allow pressure residing within the container body 12 to preferably be initially released through the vent aperture 20 as opposed to the drink apertures 18*a*, 18*b*. In one embodiment, the vent aperture 20 is provided in a position in the lid housing 40 that is underneath the trigger member 42.

Figure 8:
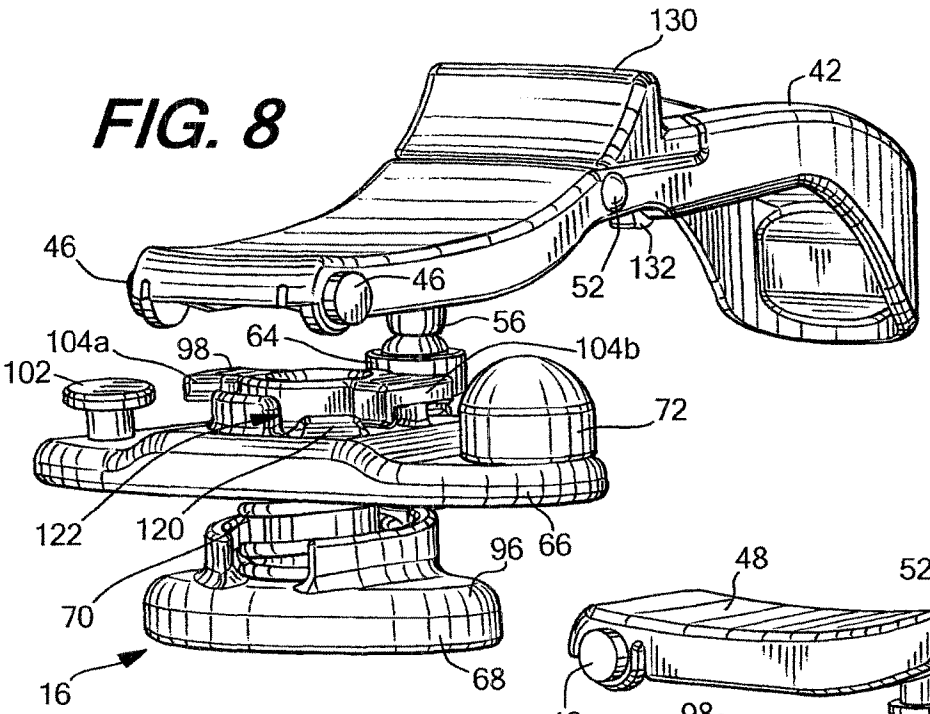
FIG. 8 is a partial front perspective view of one embodiment of the seal mechanism with the lid housing removed.
Figure 9:
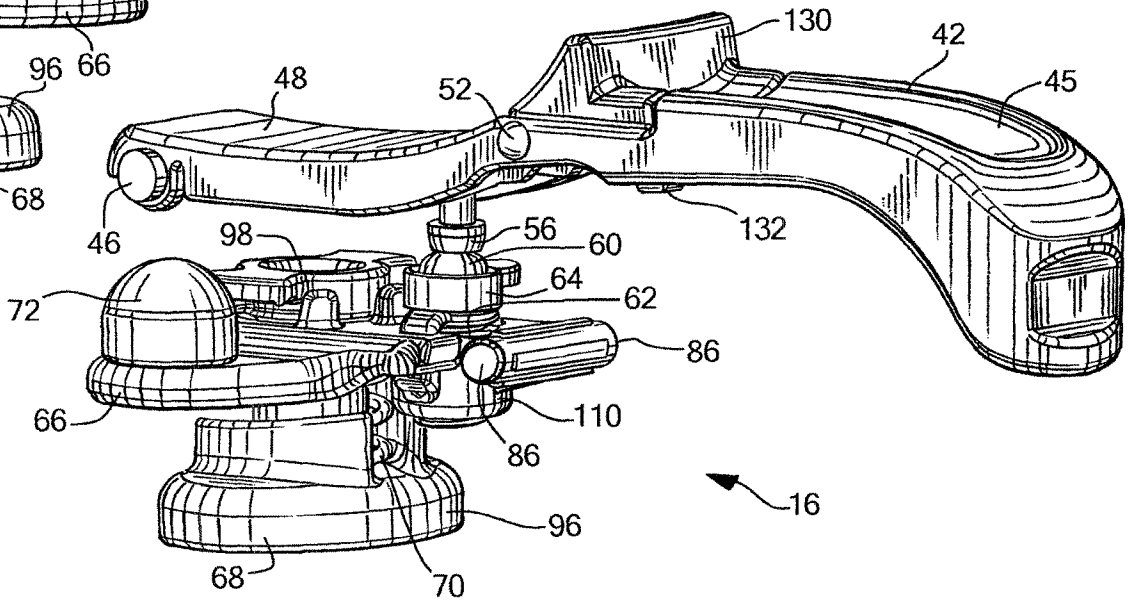
FIG. 9 is a partial rear perspective view of the view of FIG. 8.
Figure 13:
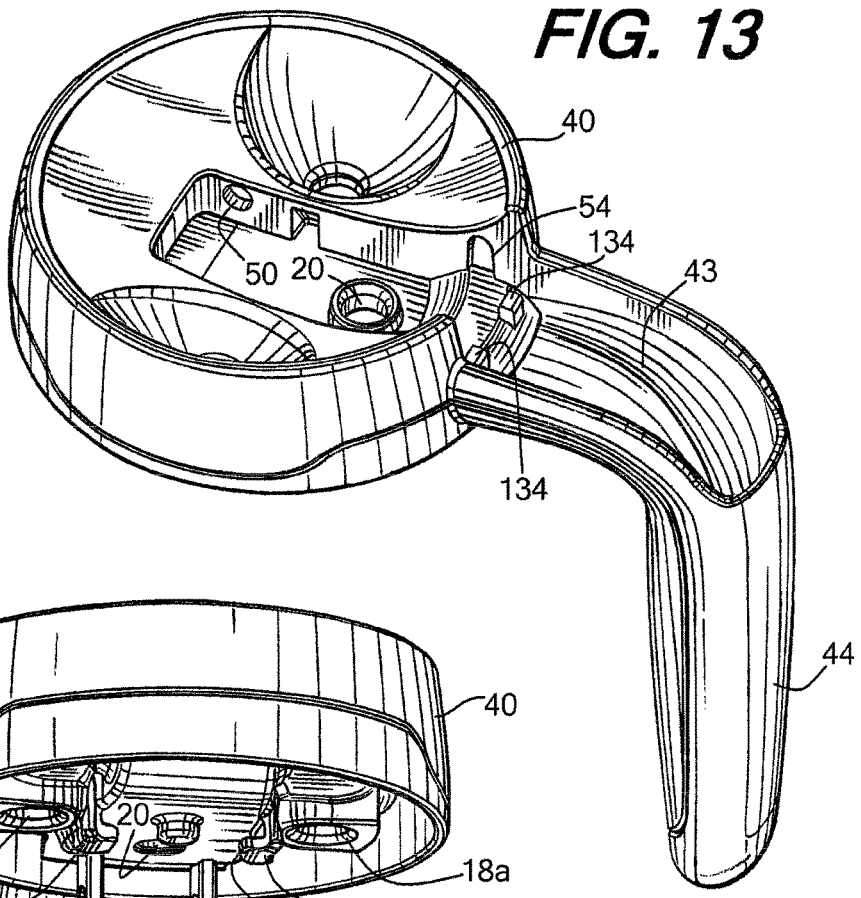
FIG. 13 is a top-side perspective view of the lid housing of FIG. 12 with the trigger button removed.

As shown in FIGS. 5 and 10-12, in one embodiment the trigger member 42 is rotatedly or pivotally attached to the lid housing 40. In a preferred embodiment of this embodiment, as shown in FIGS. 8 and 9, the trigger member 42 has a pair of cylindrical flanges or shaft extensions 46 extending from a distal end 48 of the trigger member 42. And, as shown in FIG. 13, the lid housing 40 has a mating pair of trigger receivers or openings 50. The shaft extensions 46 are able to pivot or rotate within trigger receivers 50 in the lid housing 40.

Figure 4:
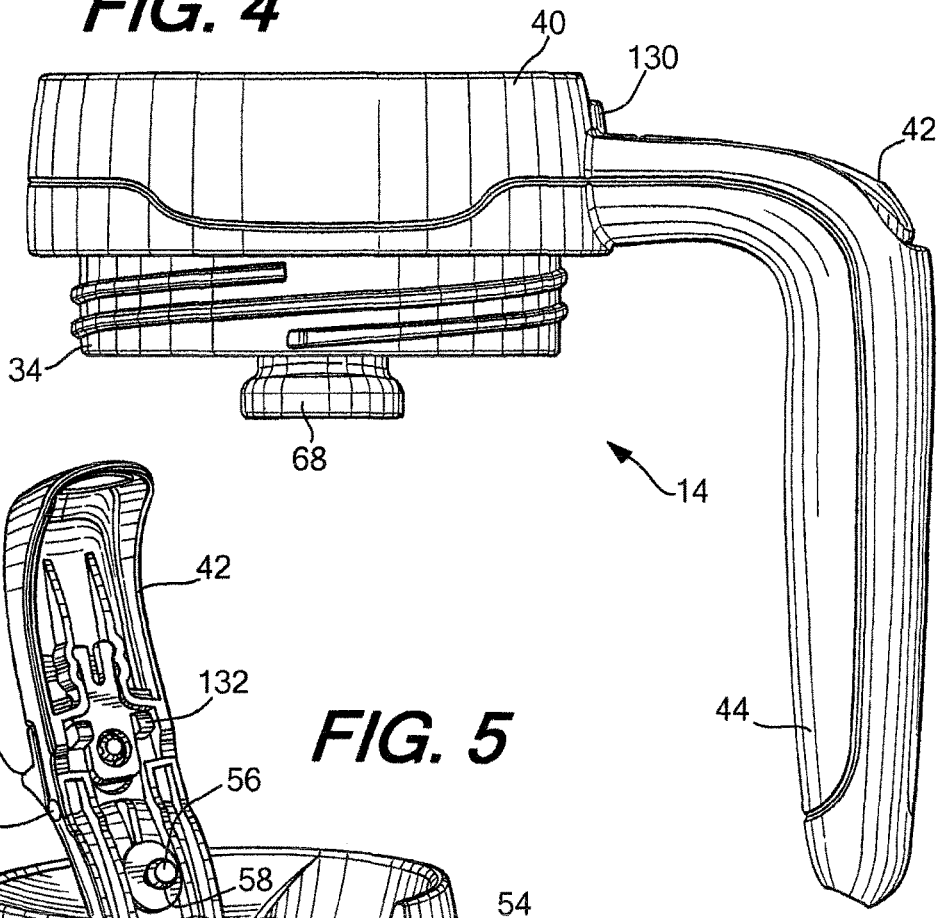
FIG. 4 is a side elevation view of FIG. 2, including a thread ring for the lid.

The trigger member 42 also has an actuation location 45, as shown in FIG. 1, where the user's thumb typically pushes on the trigger member 42 to actuate the seal assembly 16. Accordingly, when the trigger member 42 is actuated, as shown in FIGS. 4 and 7, the trigger member 42 pivots about the shaft extensions 46 that rotate within the trigger receivers 50.

Figure 5:
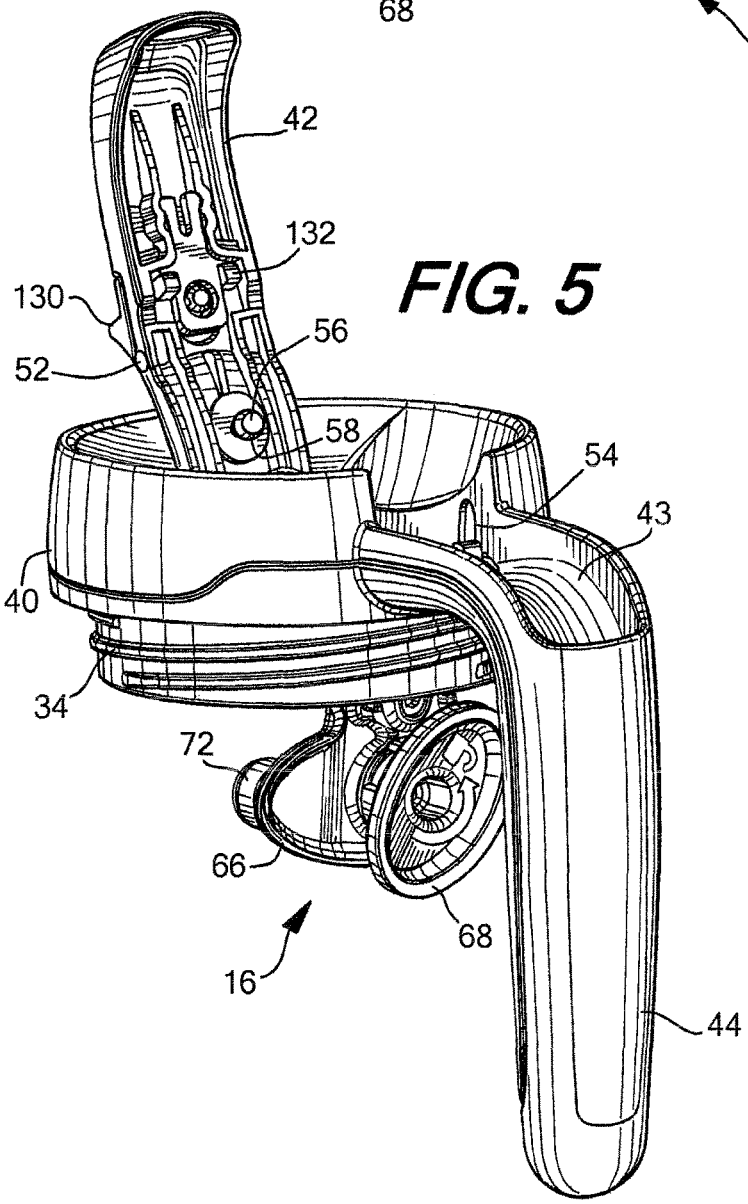
FIG. 5 is a perspective view of the lid with the trigger button and trigger assembly in the open positions.

In another embodiment, as shown in FIGS. 8 and 9, the trigger member 42 also has a pair of protrusions 52 extending from a sidewall of the trigger member 42. The protrusions 52 mate with receiving slots 54 in the lid housing 40. Thus, during use of the beverage container 10, the protrusions 52 are maintained in the receiving slots 54 in both the actuated and normal position of the trigger member 42. However, for cleaning, a force can be exerted on the trigger member 42 to release the protrusions 52 from the receiving slots 54 to rotate the trigger member 42 upwardly and away from the lid housing to expose an area between the trigger and the lid housing for cleaning, as shown in FIGS. 5 and 12, to allow for cleaning under the trigger member 42 and within the trigger cavity 43, also referred to as the vent chamber. Thus, the trigger member 42 can be rotated from a normal or use position to an open position for cleaning purposes.

Referring again to FIGS. 5, 7-9 and 12, in one embodiment a trigger post 56 extends from the trigger member 42. The trigger post 56 operates to convert the pivoting or rotating actuation of the trigger member 42 into an actuation of the seal assembly 16. As shown in FIGS. 5, 7 and 12, in one embodiment a trigger seal 58 is secured to the trigger post 56. Referring to FIG. 7, the trigger seal 58 operates to seal the vent opening 20 when the seal assembly 16 is actuated. Accordingly, in such an embodiment when the trigger button 42 is depressed, the trigger member 42 will rotate downwardly and the trigger post 56 will push downwardly against the vent pin 60. The vent seal 64 on the vent pin 60 will release from the vent opening 20 providing fluid communication with the container cavity through the vent opening 20. As the trigger member 42 is fully depressed, and after a sufficient amount of pressure has been released from the container cavity, the trigger seal 58 will operate to then close the vent opening 20 and prevent liquid from escaping through the vent opening 20 during drinking by the user. A vent spring 62, shown in FIGS. 7 and 9, operates to push against the vent pin 60 to maintain the vent seal 64 closed against the lid housing 40 to close the vent opening 20. However, the force of the depressed trigger member 42 is sufficient to overcome the spring force of the vent spring 62 to open the vent opening 20. When the user removes force from the trigger member 42 the vent spring 62 will operate to close the vent seal 64 against the vent opening 20. In an alternate embodiment, the vent pin 60 and vent seal 64 are connected to the lid housing 40.

As best shown in FIGS. 2, 3 and 6-11, in various embodiments the seal assembly 16 generally comprises a vent pin 60, a vent spring 62, a vent seal 64, a seal arm 66, a seal arm locking member 68, a drink spring 70, and a pair of drink seals 72. Referring to FIGS. 9-11, in one embodiment the seal assembly 16 is rotatedly or hingedly connected to the lower or interior portion of the lid housing 40 of the lid assembly 14. Preferably, in this embodiment, a pair of arms 80 extend transversely from the interior wall 82 of the lid housing 40 (see FIGS. 10 and 14). The arms 80 have a receiver for rotatably securing the seal arm 66 to the lid housing 40. The receiver 84 in the arms 80 is a bore that is sized to allow extensions 86 from the seal arm 66 to extend and rotate therewithin. Referring to FIG. 9, in one embodiment the extension 86 has shaft-like ends that extend into the receivers 84 in the arms 80 of the lid housing 40. As such, the seal arm 66, and a portion of the seal assembly 16 therewith, can rotate down, approximately 90° in a preferred embodiment from the operable position to the cleaning position, from its engaged position about the extensions 86 that rotate within the receivers 84 to allow access to various components of the seal assembly 16 and lid assembly 14 for cleaning purposes.

Figure 14:
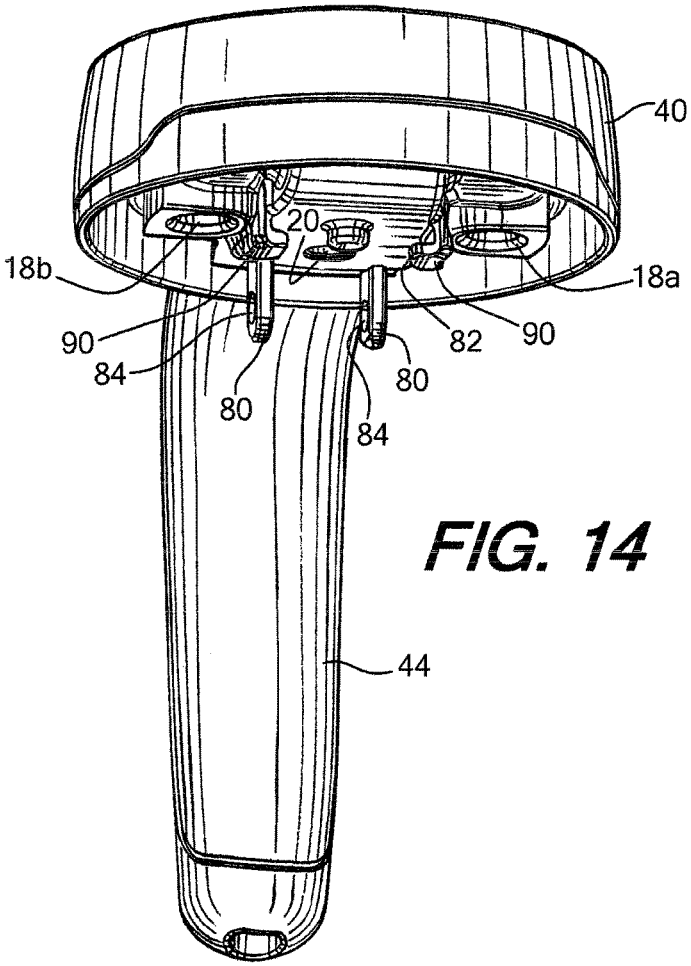
FIG. 14 is a bottom-front perspective view of the lid housing of FIG. 12 with the seal mechanism removed.

As shown in FIGS. 6, 10 and 14, in one embodiment the lid assembly 14 also has a pair of retaining prongs 90 that extend transversely from the interior wall 82 of the lid housing 40. In one embodiment the retaining prongs 90 are generally L-shaped and have a transverse and horizontal portion thereto. The horizontal portions of the pair of retaining prongs 90 extend toward one another as shown in FIG. 6. As explained herein, the retaining prongs 90 operate to assist in securing a portion of the seal assembly 16 to the lid assembly 14. Specifically, the retaining prongs 90 operate to secure a portion of the seal arm locking member 68 when the seal arm locking member 68 is orientated in the locked position (see FIG. 6).

Referring to FIGS. 6-9, connected to the seal arm 66 of the seal assembly 16 is the seal arm locking member 68, drink spring 70, and a pair of drink seals 72. The seal arm locking member 68 is the component of the seal assembly 16 that is used to lock the seal assembly 16 in the operable position, and unlock the seal assembly 16 for transitioning to the unlocked or cleaning position. In one embodiment, as shown in FIGS. 6 and 7, the seal arm locking member 68 comprises a locking member 96 and an arm lock 98 that are joined to form a unitary seal arm locking member 68 component. Further, in one embodiment the locking member 68 is rotatably connected to the seal assembly 16. In one embodiment, the locking member 96 is fixedly secured to the arm lock 98, such as with a rivet 100. Alternately, the locking member 96 may be fixedly secured to the arm lock 98 with other mechanical means, including adhesives. The locking member 96 locks the seal assembly 16 in the operable position when the locking member 96 is in a locked state. The locking member 96 is transitionable to an unlocked state to allow the seal assembly 16 to translate to the cleaning position. In one embodiment, prior to connecting the locking member 96 to the arm lock 98, the seal arm 66, which has a bore therethrough, is positioned between the locking member 96 and the arm lock 98 of the seal arm locking member 68. The seal arm 66 also has opposing extensions 102, each of which retain a drink seal 72. The drink spring 70 is positioned between the locking member 96 of the seal arm locking member 68, and preferably within a spring retainer of the locking member 96, and the bottom of the seal arm 66. Accordingly, the drink spring 70 exerts a pressure on the seal arm 66 such that the seal arm 66 is forced away from the locking member 96 of the seal arm locking member 68. Thus, when the seal assembly 16 is positioned in the locked or operational position (see FIG. 2), the drink seals 72 will be forced against the lid housing 40 to close the drink apertures. Specifically, in one embodiment the first drink seal 72 engages the first drink aperture 18*a* and the second drink seal 72 engages the second drink aperture 18*b*. In a preferred embodiment the drink seals 72 have a domed shape to provide for good sealing with the drink apertures 18*a* and 18*b*, but also to allow liquid that is not consumed by the user during operation of the drinking container 10 to pass by the drink seals 72 and into the container cavity more easily and without disruption. Further, in a preferred embodiment, the drink spring 70 has a greater spring force than the vent spring 62. In this manner, when the user depresses the trigger member 42, because the vent spring 62 has a lower spring force than the drink spring 70, the vent pin 60 will be actuated before the seal arm 66, thereby allowing the vent aperture 20 to be opened before the drink aperture to release pressure from inside the beverage container through the vent opening 20.

In the locked position of the seal assembly 16, see FIGS. 2, 3 and 6-9, the seal assembly 16 is pivoted or rotated toward the drink surface of the lid housing 40 and is locked in place. Specifically, in one embodiment the arm lock 98 portion of the seal arm locking member 68 has two wing arms 104*a*, 104*b*. The wing arms 104*a*, 104*b* each have a cam surface that engages the horizontal portion of the respective retaining prongs 90 (see FIG. 6). In this position, the seal arm locking member 68 is secured to the lid housing 40 through the retaining prongs 90, and the drink seals 72 of the seal assembly 16 are forced against the drink openings via the drink spring 70 to close the drink openings.

When the user desires to drink from the container 10, the user depresses the trigger member 42. In one embodiment, the trigger 42 is operated by pushing the trigger 42 in a direction substantially parallel to a longitudinal axis of the drinking container. If sufficient force is provided, the trigger member 42 initially depresses the vent pin 60 and vent seal 64 downwardly, compressing the vent spring 62 to initially open the vent aperture 20 during this first portion of the operation of the trigger mechanism. The vent pin 60 will ultimately bottom out in the vent pin receiver 110 of the seal arm 66. Again, if sufficient force is provided through the trigger member 42, during a second portion of the operation stroke of the trigger mechanism, when the vent pin 60 bottoms out in the vent pin receiver 110 of the seal arm 66, the force of the vent pin 60 moving downward will operate to push the seal arm 66 and compress the drink spring 70 to rotate the seal arm 66 about the extensions 86 within the receivers 84 of the lid housing arms 80. Since the seal arm locking member 68 is fixed in the locked position to the retaining prongs 90, the force exerted on the trigger member 42 must also be sufficient to overcome the force of the drink spring 70, thus allowing the seal arm 66 to compress the drink spring 70 and have the drink seals 72 moved away from the drink apertures to allow liquid to escape out of the drink apertures for drinking. Accordingly, the trigger mechanism is mechanically connected to the seal assembly, including the vent seal and the drink seals, during operation of the trigger mechanism to move the first and second drink seals and the vent seal from the closed position to the open position.

When the user removes force from the drink trigger 42 (i.e., generally by removing their thumb from the trigger 42), the force of the drink spring 70 will force the seal arm 66 to rotate toward the lid housing 40 and thereby have the drink seals 72 forced against the drink openings to close the drink openings. Further, the force of the vent spring 62 will force the vent pin 60 and vent seal 64 upwardly toward the lid housing 40 to close the vent opening 20. Accordingly, the trigger mechanism has three positions, a first position, a second position and a third position. The vent aperture is opened and the first and second drink apertures remain closed when the trigger mechanism reaches the first position. The first and second drink apertures are opened after the vent aperture when the trigger mechanism reaches the second position. Finally, the vent opening is subsequently closed but the first and second drink apertures remain open when the trigger mechanism is in the third position.

If the user desires to clean the lid assembly 14, the user can rotate the seal assembly 16 away from the drink surface of the lid housing 40 to provide access to the area between the drink openings 18*a*, 18*b* and the drink seals 72, and access to the area between the vent seal 64 and the vent opening 20. To do such, in one embodiment the user rotates the locking member 96 of the seal arm locking member 68 approximately 50°. By rotating the locking member 96, the arm lock 98 is also rotated and the wing arms will be disengaged from the retaining prongs 90 extending from the lid housing 40. When the wing arms of the arm locks 98 are disengaged from the retaining prongs 90 the entire trigger assembly 16 can be rotated away from the lid housing 40 about the extensions 86 of the seal arm 66 for cleaning. An additional feature of this embodiment is that the arms 80 interact with ribs on the seal arm 66 in a detent position to maintain the seal assembly 16 in the fully open position until forced back by the user. In this manner the seal assembly 16 will stay in the open position for cleaning, but can then be returned to its operating position by overcoming the detent resistance force. Accordingly, it is seen that the trigger member 42 is capable of engaging the seal assembly 16 when the seal assembly 16 is in the operable position, but the seal assembly 16, by nature of its physical location, cannot be engaged by the trigger member 42 when the seal assembly 16 is in the cleaning position.

As shown in FIG. 8, the surface of the seal arm 66 adjacent the arm lock 98 of the seal arm locking member 68 has a protrusion 120 and a stop 122 that operate as cams against the wing arms 104*a*, 104*b* of the arm lock 98. Specifically, in one embodiment the two wing arms 104*a*, 104*b* engage the protrusion 120 when rotating the seal arm locking member from the unlocked to the locked position, and depressions at the end of the protrusion 120 provide a tactile sensation to the user that the proper rotation stroke has been reached when unlocking the seal arm locking member 68.

To lock the seal arm locking member 68, and thus the seal assembly 16, the user pushes the seal assembly 16 toward the lid housing 40 and performs a reverse rotation of the locking member 68. When this reverse rotation of the seal arm locking member 68 is performed and completed, the stop 122 of the seal arm 66 will operate to block further movement of the seal arm locking member 68 and the wing arms 104*a*, 104*b* of the arm lock 98 will be properly seated on the retaining prongs 90.

The lid assembly 14 also has a trigger locking mechanism to prevent the trigger member 42 from being actuated when the seal assembly 16 is in the locked position. Specifically, a locking member 130 portion of the trigger member 42 can be transitioned from the unlocked position, where the trigger member 42 can be rotated to actuate the seal assembly 16, to a locked position, where the trigger member 42 cannot be rotated to actuate the seal assembly 16. The locking member portion 130 of the trigger member 42 is shown in FIGS. 5-7. The locking member portion 130 of the trigger member 42 is moveable radially inwardly and outwardly on the trigger member 42 when the trigger member 42 is connected to the lid housing 14. The locking member portion 130 also has protrusions 132 that extend into the cavity 43 of the handle 44. In the unlocked position the protrusions 132 do not contact anything and thus the trigger member 42 can be freely depressed. When the locking member portion 130 is slid radially inward (i.e., toward a center of the lid 40) to the "Locked Position," the protrusions 132 on the locking member portion 130 line up with a raised cam surface 134 (see FIG. 12) extending from the lid housing 40 in the cavity 43. Thus, in this Locked Position the raised cam surface 134 engages the protrusions 132 and prevents the trigger member 42 from being depressed. When the locking member portion 130 of the trigger member 42 is slid back to the unlocked position, the protrusions 132 do not line up with the raised cam surfaces 134 and the trigger 42 can be freely depressed to actuate the seal assembly 16. Additionally, as seen in FIG. 1, the locking member portion 130 of the trigger member 42 forms a continuous circular ring portion of the lid housing 40 at the upper outer surface of the lid housing 40 when the locking member 130 is in the unlocked state. However, when the locking member 130 is transitioned to the locked state, the continuous circular ring portion of the upper outer surface of the lid housing 40 is broken (i.e., the locking member 130 is moved radially inward), providing a visual indication to the user that the trigger member 42 is locked and the seals cannot be operated.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lid assembly for a beverage container, comprising:

a lid housing having a drink aperture and a vent aperture;

a seal assembly having a stopper to selectively close the drink aperture, the seal assembly movable between a use position and a cleaning position, the seal assembly permanently connected to the lid assembly, the seal assembly having a locking member to lock the seal assembly in the use position, the stopper adapted to close the drink aperture when the seal assembly is in the use position, the stopper movable, relative to the drink aperture, to open the drink aperture when the seal assembly is in the use position, wherein the seal assembly further comprises a vent seal that selectively closes the vent aperture; and a trigger member pivotally coupled to the lid housing, the trigger member adapted to engage the seal assembly to open and close the drink aperture when the seal assembly is in the use position.

2. The lid assembly of claim 1, wherein the seal assembly has a detent to retain the seal assembly in the cleaning position until a sufficient force is applied to overcome the detent and move the seal assembly from the cleaning position toward the use position.

3. The lid assembly of claim 1, wherein the locking member is transitionable between a locked state and an unlocked state, the seal assembly being able to be moved to the cleaning position when the locking member is in the unlocked state.

4. The lid assembly of claim 1, wherein the seal assembly has a seal arm, wherein the seal arm is adjacent the drink aperture in the use position and wherein the seal arm is distal the drink aperture in the cleaning position, the seal arm being indirectly connected to the lid housing when the seal assembly is in the use position and the cleaning position, the use position being an operable position for assisting in opening and closing the drink aperture, and wherein the stopper is not capable of assisting in closing the drink aperture in the cleaning position.

5. The lid assembly of claim 1, wherein the stopper comprises a drink seal to selectively close the drink aperture.

6. The lid assembly of claim 1, wherein the trigger member is permanently connected to the lid assembly, wherein the seal assembly cannot be operated by the trigger member to open and close the drink aperture when the seal assembly is in the cleaning position.

7. The lid assembly of claim 1, wherein the seal assembly pivots away from a drink surface of the lid housing when it moves to the cleaning position.

8. The lid assembly of claim 7, wherein the seal assembly can pivot at least 90° to transition from the use position to the cleaning position.

9. The lid assembly of claim 1, wherein the stopper is unable to close the drink aperture when the seal assembly is in the cleaning position.

10. The lid assembly of claim 1, wherein the seal assembly comprises a seal arm having the stopper, wherein the trigger member is adapted to engage the seal arm to open and close the drink aperture when the seal assembly is in the use position, wherein the trigger member is unable to engage the seal arm to open or close the drink aperture when the seal assembly is in the cleaning position, and wherein the trigger member operates to engage the seal arm to open the drink aperture responsive to a user directly engaging the trigger member.

11. The lid assembly of claim 10, wherein the locking member is transitionable to an unlocked state to allow the seal assembly to be moved to the cleaning position.

12. The lid assembly of claim 10, wherein the stopper comprises a drink seal connected to the seal arm when the seal assembly is in the use position and the cleaning position.

13. The lid assembly of claim 10, wherein the trigger member is permanently connected to the lid assembly.

14. The lid assembly of claim 10, wherein the seal arm pivots away from a drink surface of the lid housing when the seal assembly moves to the cleaning position.

15. The lid assembly of claim 10, wherein the seal arm pivots at least 90° to transition the seal assembly from the use position to the cleaning position.

16. The lid assembly of claim 1, wherein the seal assembly comprises a seal arm having the stopper, wherein the trigger member is adapted to engage the seal arm to open and close the drink aperture when the seal assembly is in the use position;

and wherein the seal arm pivots away from the lid housing when the seal assembly is moved from the use position to the cleaning position.

17. The lid assembly of claim 16, wherein the lid assembly further comprises a thread ring to connect the lid housing to the beverage container, the seal arm partially covering a portion of the thread ring when the seal assembly is in the cleaning position.

18. The lid assembly of claim 16, wherein the seal arm has a detent to retain the seal assembly in the cleaning position until a sufficient force is applied to overcome the detent and move the seal assembly from the cleaning position toward the use position.

19. The lid assembly of claim 16, wherein the trigger member cannot operate the seal arm to open and close the drink aperture when the seal assembly is in the cleaning position.

20. The lid assembly of claim 16, wherein a portion of the trigger member is disposed radially outward of the lid housing.

* * * * *